US007537112B2

(12) United States Patent
Balazik

(10) Patent No.: US 7,537,112 B2
(45) Date of Patent: May 26, 2009

(54) DRINK MIX SYSTEM

(76) Inventor: Ronald Frank Balazik, 9517 Ferry Harbour Ct., Alexandria, VA (US) 22039

( * ) Notice: Subject to any disclaimer, the term of this patent is extended or adjusted under 35 U.S.C. 154(b) by 575 days.

(21) Appl. No.: 11/196,420

(22) Filed: Aug. 4, 2005

(65) Prior Publication Data

US 2007/0029214 A1 Feb. 8, 2007

(51) Int. Cl.
*B65D 25/08* (2006.01)
*B65D 1/04* (2006.01)

(52) U.S. Cl. ..... 206/222; 206/219; 215/6

(58) Field of Classification Search ..... 206/219, 206/221, 222, 217, 568; 215/6
See application file for complete search history.

(56) References Cited

U.S. PATENT DOCUMENTS

| | | | | |
|---|---|---|---|---|
| 2,824,010 | A * | 2/1958 | Pedersen | 426/120 |
| 4,024,952 | A | 5/1977 | Leitz | |
| 6,059,443 | A * | 5/2000 | Casey | 366/130 |
| 6,170,654 | B1 | 1/2001 | Gartner et al. | |
| 6,363,978 | B2 * | 4/2002 | Castillo | 141/100 |
| 6,372,270 | B1 * | 4/2002 | Denny | 426/77 |
| 6,527,109 | B2 | 3/2003 | Schoo et al. | |
| 6,561,232 | B1 | 5/2003 | Frutin | |
| 6,843,368 | B1 | 1/2005 | Frutin | |
| 7,159,374 | B2 * | 1/2007 | Abercrombie et al. | 53/432 |
| 2004/0026270 | A1 * | 2/2004 | Liang | 206/219 |
| 2004/0040964 | A1 | 3/2004 | Ullmann | |
| 2004/0200741 | A1 | 10/2004 | Cho | |
| 2005/0040052 | A1 * | 2/2005 | Dixon | 206/217 |
| 2005/0178677 | A1 * | 8/2005 | Morrow | 206/219 |

FOREIGN PATENT DOCUMENTS

| | | |
|---|---|---|
| JP | 2282063 | 11/1990 |
| JP | 6247477 | 9/1994 |
| JP | 2002114259 | 4/2002 |
| JP | 2002249175 | 9/2002 |
| JP | 200372822 | 3/2003 |
| JP | 2004256136 | 9/2004 |
| WO | 97/48617 | 12/1997 |
| WO | 2004/060766 | 7/2004 |

OTHER PUBLICATIONS

"NutriSystem Launches Revolutionary Water Product", Market Wire, http://press.arrivenet.com/entertainment/print.php?url, 2 pages, printed Apr. 11, 2005.

* cited by examiner

*Primary Examiner*—J. Gregory Pickett
(74) *Attorney, Agent, or Firm*—Diederiks & Whitelaw, PLC

(57) ABSTRACT

A drink mix system includes a disk having first and second additives, an additional additive coated on an end wall of a threaded bottle cap, and a seal. The disk is adapted to be self-retaining within a bottle cap. The additives are sandwiched between the seal and the end wall when in a sealed position such that liquid within a bottle can not contact the additives when the cap is mated to the bottle. Alternatively, rather than a disk, a bullet-shaped nugget having an outer additive layer and an inner additive layer is sandwiched between the seal and the end wall of the cap. When desired, a user removes the seal and selectively mixes one or more of the additives with the liquid in the bottle. This results in an inexpensive drink mix system that can utilize standard bottle caps and allows a user to selectively flavor a beverage.

17 Claims, 2 Drawing Sheets

DRINK MIX SYSTEM

BACKGROUND OF THE INVENTION

1. Field of the Invention

The present invention pertains to the art of drink mix systems and, more specifically, to an additive mixing system for containers including an additive sealed within a cap that can be selectively added to a beverage by a user. The invention is used for soft drinks, juices, bottled water, alcoholic beverages and other marketed drinks.

2. Discussion of the Prior Art

Several hundred billion containers of beverages are sold throughout the world every year. Generally, they are limited to only one flavor per container, and the total range of flavors available from bottlers is quite limited when compared with the vast quantities sold and the many millions of consumers involved. Thus far, simple, inexpensive options that allow each consumer the freedom to enhance or multiply flavors for satisfying individual tastes are generally unavailable.

Virtually all conventional beverage bottles now marketed have a narrow threaded neck adapted to mate with a threaded, small diameter cap. Thus, consumers who wish to add their own flavoring to a beverage (e.g., lemon concentrate to bottled water) must remove the cap and insert their additive through the narrow bottle opening—a procedure that can be inefficient, untidy and inconvenient.

One system's approach that has been explored for introducing additives within a closed container is to package the additives within storage cells incorporated into specifically designed caps. For example, U.S. Pat. Nos. 6,170,654 and 6,561,232 disclose caps shaped to include storage areas that release additives into a beverage or liquid upon opening of the cap, but do not allow a user to choose a range of additives or the quantity to be added. In other systems (e.g., U.S. Pat. No. 6,372,270, Japanese Patent Document No. 2003/072822 and World Patent Document No. 2004/060766), an additive also is housed in a storage area of a cap such that a user can mix the additive with a liquid. However, these systems further require specifically constructed containers and caps, thereby increasing manufacturing costs.

As a consequence of the system limitations cited above, there remains a need in the art for an additive mixing system that is inexpensive to manufacture, allows a user to easily introduce several additives to a beverage and that can utilize standard beverage bottle caps.

SUMMARY OF THE INVENTION

The present invention is directed to a drink mix system including a disk having first and second additives, an additional additive coated on an end wall of a threaded cap, and a seal. Preferably, the disk is adapted to be self-retaining within a standard cap and includes tabs for easy removal/disposal. The first, second and additional additives are sandwiched between the seal and the end wall of the cap when in a sealed position such that liquid within a container can not contact the additives when the cap is mated to the container. In an alternative embodiment, a nugget, preferably bullet-shaped for even solubility, having an outer additive layer and an inner additive layer is sandwiched between the seal and the end wall of the cap in place of the disks. When desired, a user removes the seal and selectively mixes one or more of the additives with the liquid in the container. This results in an inexpensive drink mix system that can utilize standard bottle caps and allows a user to selectively add one or more flavors to a beverage. Moreover, the adaptability of the invention to standardized bottle and cap designs allows for the alternative production and introduction of new flavors not provided by the beverage industry.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
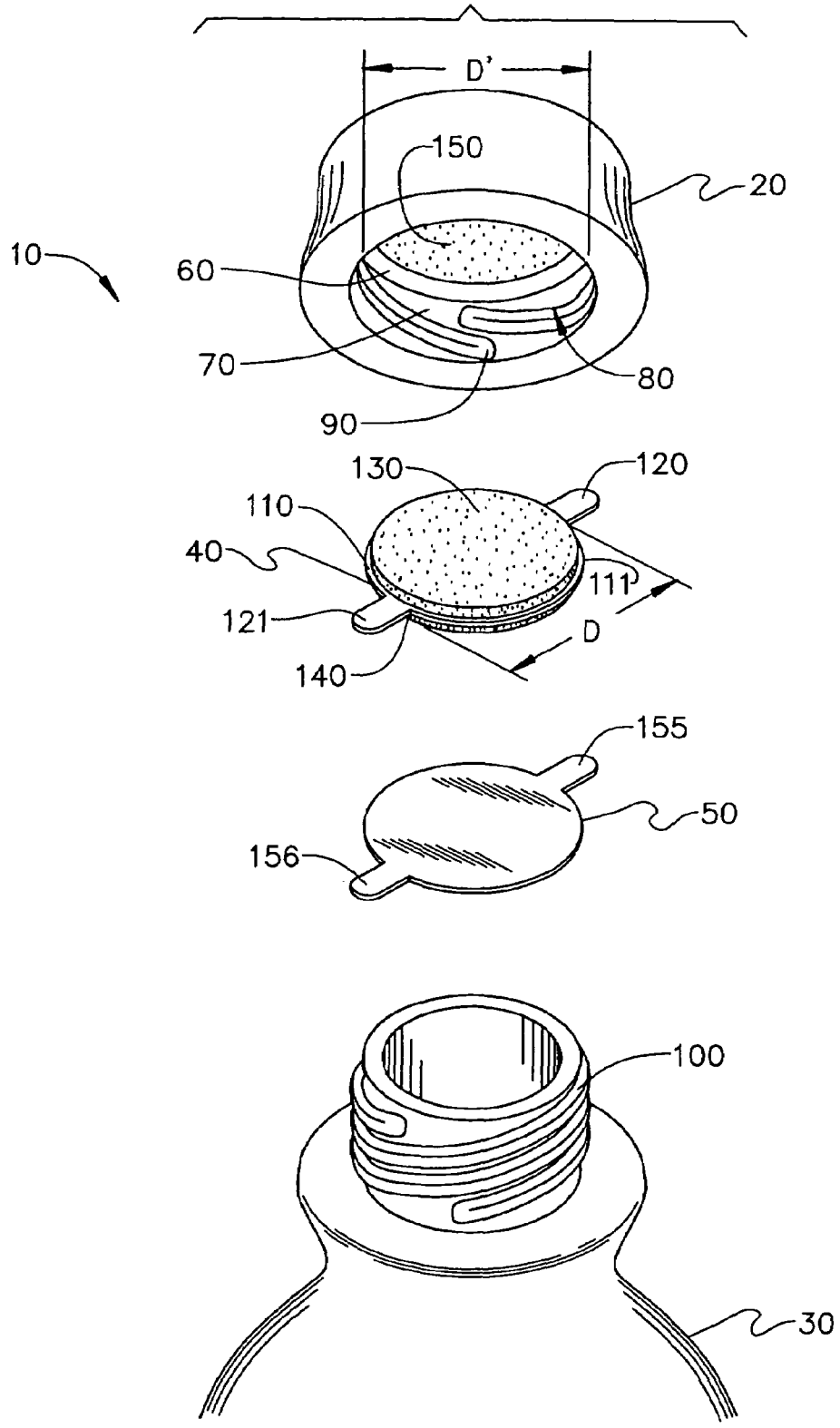
FIG. 1 is a perspective exploded view of a first embodiment of the drink mix system of the present invention.

With initial reference to FIG. 1, a drink mix system 10 includes a bottle cap 20 used to close a bottle 30, a disk 40 and a seal 50. Cap 20 includes an end wall 60 and a side wall 70 which collectively define an inner portion 80. Cap 20 can be any cap having threads 90 that extend from side wall 70 and are adapted to mate with threads 100 on bottle 30. Preferably, cap 20 and bottle 30 have standard structures and shapes; thus allowing bottles and caps currently on the market to be used with little or no modification in conjunction with the present invention. Disk 40 includes first and second sides 110 and 111, and preferably also includes first and second diametrically opposed tabs 120 and 121. Disk 40 is formed from cardboard, plastic, foam or any other thin flexible material capable of supporting a beverage or drink additive. A first drink additive 130 is coated on first side 110 of disk 40. Preferably, for a greater range of additives, a second drink additive 140 is coated on second side 111 of disk 40. Optionally, an additional (third) drink additive, or layer of additive 150 is coated on end wall 60 of cap 20. Additional drink additive 150 is used by itself in drink mix system 10, or is used in combination with disk 40. Likewise, disk 40 is used by itself in drink mix system 10 or is used in combination with additional drink additive 150. Drink additives 130, 140 and 150 may be any type and combination of desired additives, such as vitamins, flavorings, colorings, etc. In one example, additive 130 includes a lemon flavoring while additive 140 includes a lime flavoring. Preferably, disk 40 is formed by depositing a fluid or semi-fluid amount of additive 130 on first side 110 and hardening the additive by drying, microwaving, cooling, radiant heat, etc. When desired, second additive 140 is then deposited on second side 111 and hardened. Likewise, additional drink additive 150 is formed by depositing a fluid or semi-fluid amount of the additive onto end wall 60 of cap 20 and hardening. In the case where disk 40 is made of an absorbent foam or sponge-like material, additives 130 and 140 are impregnated within disk 40 or deposited on the surface thereof. Seal 50, which is adapted to seal off disk 40 and end wall 60 of cap 20 from any liquid contained within bottle 30, is manufactured from plastic, foil, or any other flexible material impermeable to liquids.

Figure 2:
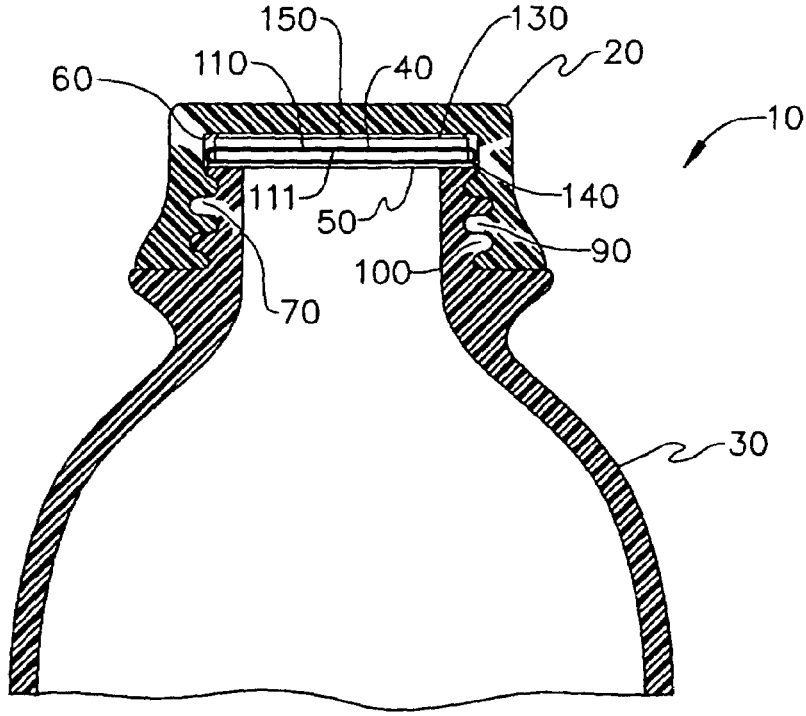
FIG. 2 is a cross-sectional side view of the embodiment of FIG. 1.

FIGS. 1 and 2 will now be referenced with respect to the way drink mix system 10 is assembled and used. The outer diameter of disk 40 is such that when disk 40 is placed into inner portion 80 of cap 20, disk 40 is self-retained within cap 20. In one example, as shown in FIG. 1, an outer diameter D of disk 40, when first and second tabs 120, 121 are folded, is substantially the same as the inner diameter D' of cap 20 such that disk 40 fits snuggly within inner portion 80. Although not shown, it is also contemplated that first and/or second tabs 120 and 121 can be left to extend from disk 40 such that the outermost diameter of disk 40 plus the length of the extended first and/or second tabs 120, 121 is substantially the same as the inner diameter D' of cap 20, such that first and/or second tabs 120 and 121 aid in retaining disk 40 within cap 20. In this manner, disk 40 can either have its first and/or second tabs 120, 121 folded to fit within a smaller diameter cap, or can have its first and/or second tabs 120, 121 extended so as to fit within a larger diameter cap. In the case where disk 40 is formed of a foam or sponge-type material, outer diameter D of disk 40 is formed slightly greater than inner diameter D' of cap 20 so that disk 40 can be slightly compressed to fit within inner portion 80, and once within inner portion 80, will expand to hold itself in place. Once disk 40 is housed within inner portion 80, seal 50 is placed over disk 40 such that disk 40 is sandwiched between end wall 60 and seal 50. Cap 20 is then screwed onto bottle 30. Seal 50 prevents any liquid contained within bottle 30 from coming into contact with disk 40, and thus with additives 130 and 140. Of course, when additional drink additive 150 is utilized in drink mix system 10, seal 50 also prevents liquid from contacting additional drink additive 150.

When a user wishes to drink from bottle 30, the user unscrews cap 20 from bottle 30 and decides to add one or more of additives 130, 140 and 150 to a liquid within bottle 30. In the case where the user desires to add all of the additives to the liquid, he/she simply removes seal 50 from cap 20, preferably with the assistance of first and second tabs 155 and 156, and replaces cap 20 on bottle 30. The second additive 140 is now exposed to the liquid within bottle 30 and the user can shake bottle 30 to dissolve a desired amount of second additive 140 into the liquid. Once the desired amount of second additive 140 has been dissolved, the user removes cap 20 from bottle 30 and flips disk 40 over such that first additive 130 is now exposed to the liquid in bottle 30. Preferably, first and second tabs 120 and 121 can be utilized to aid a user in flipping disk 40. Next, the user replaces cap 20 on bottle 30 and shakes bottle 30 to dissolve a desired amount of first additive 130 in the liquid. The user can then remove cap 20 from bottle 30 for a third time, remove disk 40 from cap 20, and replace cap 20 on bottle 30. This allows additional drink additive 150 to be exposed to the liquid in bottle 30. Finally, the user can shake bottle 30 to dissolve a desired amount of additional drink additive 150 in the liquid. Of course, if a user does not wish to add a particular additive to the liquid, the mixing step associated with that particular additive can be skipped. For example, if a particular cap 20 includes only disk 40 having a first additive 130 which is lemon flavored and a second additive 140 which is lime flavored, a user can choose to dissolve only the lime flavored additive in the liquid within bottle 30. In another example, if a particular cap includes a cherry flavored additional drink additive 150, a user can choose to add or ignore the cherry flavored additive. Drink mix system 10 therefore allows a user to flavor a bottled beverage to his or her particular tastes, or to enjoy a sequence of several different flavors while proceeding to consume a beverage.

Figure 3:
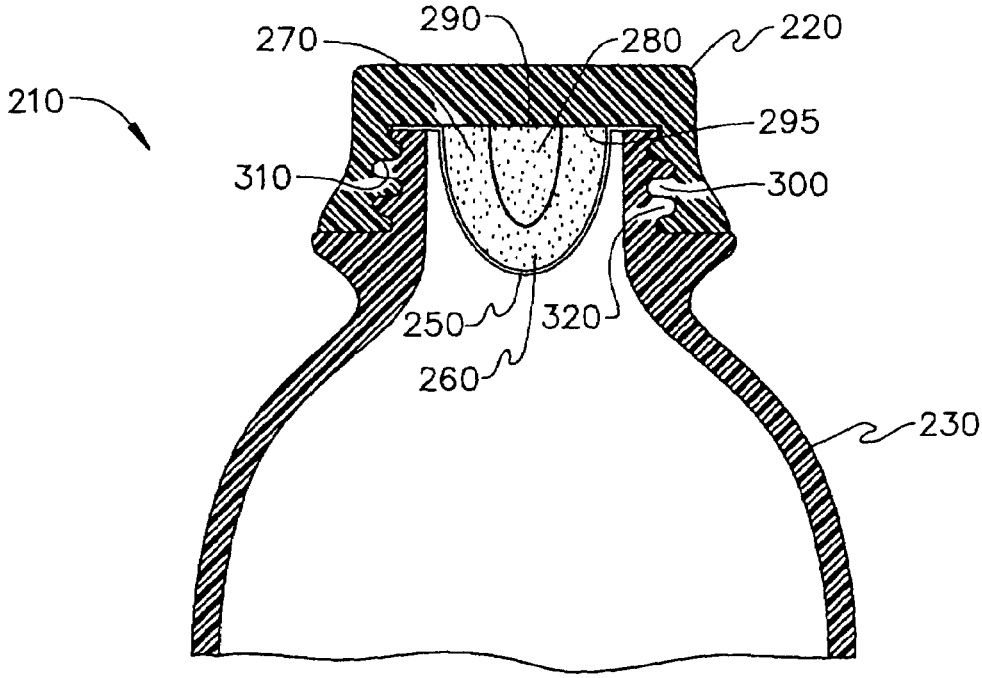
FIG. 3 is a cross-sectional side view of a second embodiment of the present invention.

Turning now to FIG. 3, there is shown a second embodiment of the present invention. A drink mix system 210 includes a bottle cap 220 adapted to close a bottle 230, a seal 250 and a nugget 260 having a first or outer additive layer 270 and optionally, a second or inner additive layer 280. Preferably, nugget 260 is bullet-shaped to aid in dissolution of nugget 260 in a liquid and includes an end wall 290. Seal 250 is placed over nugget 260 to sandwich nugget 260 between seal 250 and an end wall 295 of cap 220, with end wall 290 of nugget 260 abutting end wall 295. Seal 250 is preferably in the form of shrink wrap, but can be foil or any other flexible material impermeable to liquid. Just as discussed in accordance with the first embodiment, cap 220 can be any cap having threads 300 that extend from a side wall 310 and are adapted to mate with threads 320 on a bottle 230. Preferably, cap 220 and bottle 230 have standard shapes; thus allowing bottles and caps currently on the market to be used in conjunction with the present invention. Nugget 260 can be formed directly on cap 220 or can be separately formed and sealed to cap 220 with seal 250. When a user desires to dissolve nugget 260 in a liquid within bottle 230, he or she simply removes cap 220 from bottle 230, removes seal 250 from cap 220, replaces cap 220 on bottle 230 and shakes bottle 230 to dissolve nugget 260 within the liquid. Outer and inner additive layers 270 and 280 can comprise any type and combination of desired additives, such as vitamins, flavorings, colorings, etc. For example, outer additive layer 270 can include lemon flavoring while inner additive layer 280 can include lime flavoring. An original flavoring in bottle 30 can be used as an additive so as to permit the user to intensify the original taste. For example, a bottle originally containing cherry soda could be fitted with additional cherry flavoring.

Although described with reference to a preferred embodiment of the invention, it should be readily understood that various changes and/or modifications can be made to the invention without departing from the spirit thereof. For instance, while preferably in a solid or semi-solid form, additives 130, 140, 150, 270 and 280 can be in the form of a gel, granulated powder or syrup without departing from the invention; also, a fourth additive could be on seal 150 to supplement disk 40. In general, the invention is only intended to be limited by the scope of the following claims.

I claim:

1. A drink mix system for mixing additives into liquid held by a container comprising:

a cap including an end wall and a side wall which collectively define an inner portion, and threads extending into the inner portion adapted to mate with threads formed on the container;

a removable seal; and a disk having a first side with a first additive affixed thereto, and a second side having a second additive affixed thereto, said disk being sandwiched between the removable seal and the end wall of the cap.

2. The drink mix system of claim 1, wherein the disk is formed of compressible material.

3. The drink mix system of claim 1, wherein the disk further comprises a first tab extending therefrom.

4. The drink mix system of claim 3, wherein the disk has a first diameter and the inner portion of a cap has a second larger diameter whereby the disk will be retained in the cap by an interference fit.

5. The drink mix system of claim 3, wherein the disk further includes a second tab extending therefrom.

6. The drink mix system of claim 1, wherein the disk is adapted to be self-retaining within the inner portion of the cap.

7. The drink mix system of claim 1, wherein the first additive includes a lemon flavoring and the second additive includes a lime flavoring.

8. A drink mix system for mixing additives into liquid held by a container comprising;

cap including an end wall and a side wall which collectively define an inner portion, and threads extending into the inner portion adapted to mate with threads formed on the container;

a removable seal;

a disk having a first side with a first additive affixed thereto, and a second side, said disk being sandwiched between the removable seal and the end wall of the cap; and an additional additive coated on the end wall of the cap such that the additional additive and the disk are sandwiched between the seal and the end wall of the cap when in a sealed position.

9. The drink mix system of claim 1, wherein the seal includes a tab to aid in removal of the seal.

10. The drink mix system of claim 1, wherein the container is a bottle.

11. The drink mix system of claim 8, wherein the seal includes a first tab to aid in removal of the seal.

12. The drink mix system of claim 8, wherein the container is a bottle.

13. The drink mix system of claim 8, wherein the disk is formed of compressible material.

14. The drink mix system of claim 8, wherein the disk further comprises a first tab extending therefrom.

15. The drink mix system of claim 14, wherein the disk has a first diameter and the inner portion of a cap has a second larger diameter whereby the disk will be retained in the cap by an interference fit.

16. The drink mix system of claim 14, wherein the disk further includes a second tab extending therefrom.

17. The drink mix system of claim 8, wherein the disk is adapted to be self-retaining within the inner portion of the cap.

* * * * *